US006886849B2

(12) United States Patent
Mandon

(10) Patent No.: US 6,886,849 B2
(45) Date of Patent: May 3, 2005

(54) SNOWBOARD BINDING

(75) Inventor: Florence Mandon, La Murette (FR)

(73) Assignee: Skis Rossignol S.A., Voiron (FR)

( * ) Notice: Subject to any disclaimer, the term of this patent is extended or adjusted under 35 U.S.C. 154(b) by 105 days.

(21) Appl. No.: 10/136,979

(22) Filed: May 2, 2002

(65) Prior Publication Data

US 2002/0163161 A1 Nov. 7, 2002

(30) Foreign Application Priority Data

May 2, 2001 (FR) ..... 01 05857

(51) Int. Cl.[7] ..... A63C 9/14

(52) U.S. Cl. ..... 280/618; 280/620; 280/634; 280/14.22

(58) Field of Search ..... 280/618, 619, 280/620, 633, 634, 11.16, 11.26, 14.22, 14.24; 441/70

(56) References Cited

U.S. PATENT DOCUMENTS

| | | | | | |
|---|---|---|---|---|---|
| 4,773,886 | A | * | 9/1988 | Teeter et al. | 441/70 |
| 5,261,689 | A | | 11/1993 | Carpenter et al. | |
| 5,344,178 | A | * | 9/1994 | Rohrmoser | 280/617 |
| 5,344,179 | A | * | 9/1994 | Fritschi et al. | 280/618 |
| 5,356,170 | A | * | 10/1994 | Carpenter et al. | 280/618 |
| 5,609,347 | A | | 3/1997 | Dressel | |
| 5,727,797 | A | | 3/1998 | Bowles | |
| 5,758,895 | A | * | 6/1998 | Bumgarner | 280/607 |
| 5,971,407 | A | * | 10/1999 | Zemke et al. | 280/14.22 |
| 5,975,557 | A | | 11/1999 | Snoke et al. | |
| 6,061,870 | A | * | 5/2000 | Dodge et al. | 16/2.1 |
| 6,113,114 | A | * | 9/2000 | Zemke et al. | 280/14.26 |
| 6,267,403 | B1 | | 7/2001 | Bossin et al. | |
| 6,283,482 | B1 | * | 9/2001 | Coulter | 280/14.22 |
| 6,283,495 | B1 | * | 9/2001 | Phillips | 280/618 |
| 6,293,566 | B1 | | 9/2001 | Carpenter et al. | |
| 6,364,323 | B1 | * | 4/2002 | Coulter | 280/14.22 |
| 6,394,484 | B1 | * | 5/2002 | Maravetz et al. | 280/624 |
| 6,581,944 | B1 | * | 6/2003 | Marmonier et al. | 280/14.22 |
| 6,609,720 | B2 | * | 8/2003 | Marmonier | 280/14.24 |

FOREIGN PATENT DOCUMENTS

| | | |
|---|---|---|
| EP | 0 852 958 A | 7/1998 |
| FR | 2 732 611 | 10/1996 |
| FR | 2 758 468 A | 7/1998 |

OTHER PUBLICATIONS

In SN FR 0105857 French Preliminary Search Report.

* cited by examiner

*Primary Examiner*—Christopher P. Ellis
*Assistant Examiner*—Jeff Restifo
(74) *Attorney, Agent, or Firm*—Bugnion S.A.; John Moetteli

(57) ABSTRACT

Snowboard binding has a base plate (1) having an arch (4), a rear support piece (24) which can be displaced on the base plate, a foot strap (13), optionally an instep strap (5), and a linking device for kinematic linking between the foot strap and the rear support piece. The kinematic linking device has linking pieces (14, 15, 25, 26) connecting the support piece (24) and the foot strap (13) and passing on each side of the central zone of the base plate. This binding may be adjusted rapidly, symmetrically or non-symmetrically, without the necessity of removing and replacing screws.

11 Claims, 6 Drawing Sheets

Fig.2
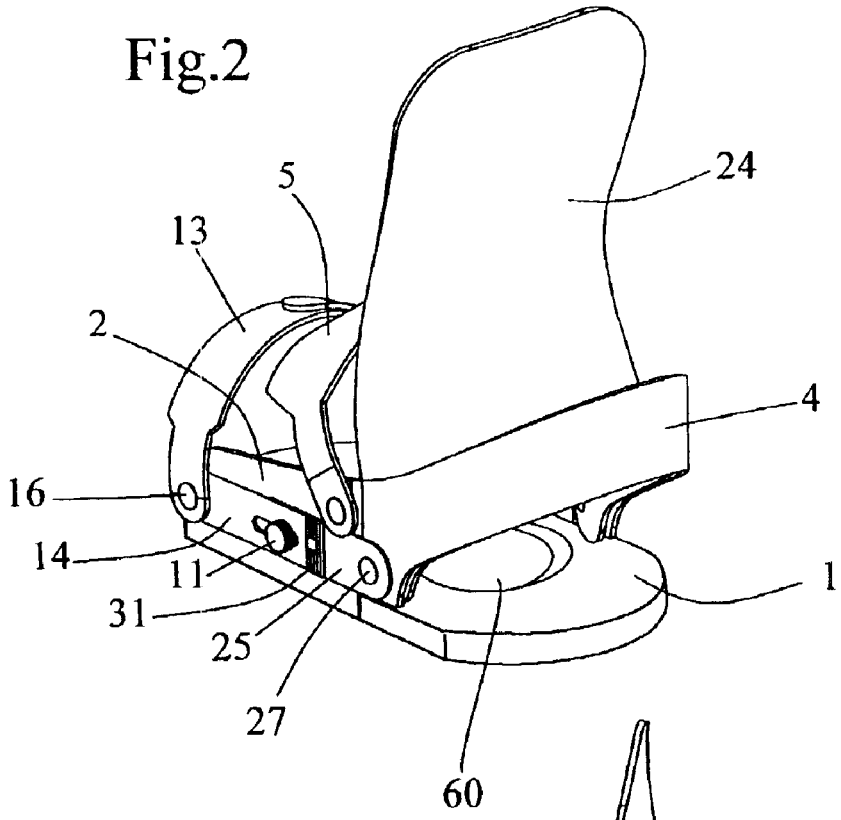
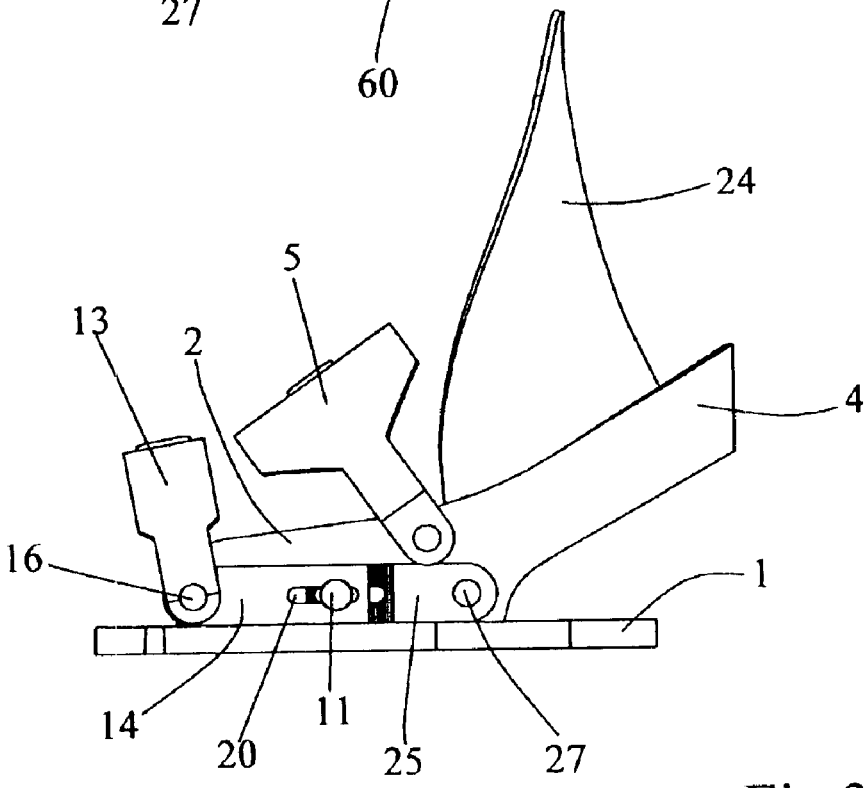
Fig.3

SNOWBOARD BINDING

BACKGROUND OF THE INVENTION

The invention relates to a snowboard binding comprising a base plate having two at least approximately parallel lateral sides and bearing:

an arch extending obliquely rearward, a rear support piece rising inside the arch and displaceable on the base plate in parallel with the lateral sides of the base plate, and a foot strap for passing over the boot in the region of the foot and displaceable on the base plate in parallel with the lateral sides of the base plate, and kinematic linking means between the foot strap and the rear support piece.

The word "strap" must in this case be understood in its widest sense. In particular, it comprises strips made from plastic material in one or two parts and their adjustable means of attachment or of coupling.

This type of binding is generally called a strap binding, as opposed to automatic step-in bindings in which the sole of the boot has to include a rigid piece interacting with a binding mechanism.

The binding in question may be equipped with two straps, a first strap for passing over the boot in the region of the instep, and a second strap for passing over the front part of the foot, or a wider, single strap extending over the foot and over the instep.

Strap bindings are generally designed so that they can be adjusted to the user's boot size. The simplest solution consists in fixing the rear support piece, or rear arch bearing the support piece, and the foot strap on two parallel vertical walls of the base plate which have a row of holes in which the rear support piece, or the arch, and the front foot strap can be positioned selectively and fixed in the holes by means of screws and nuts. A construction of this type is described in documents U.S. Pat. No. 5,609,347, the content of which is incorporated by reference, and U.S. Pat. No. 5,727,797, the content of which is incorporated by reference. In the case of an arch fixed on the base plate, it has been proposed in document U.S. Pat. No. 5,261,689, the content of which is incorporated by reference to replace the holes for positioning the rear support piece with an aperture with a notched periphery, a fixing member being fixed in the notched part.

Document U.S. Pat. No. 6,283,482, the content of which is incorporated by reference describes a strap binding in which the rear support piece is fixed in a similar manner to that described in document U.S. Pat. No. 5,261,689, the content of which is incorporated by reference, the fixing member including a notched small plate that can be tightened and loosened using a cam lever, allowing rapid adjustment of the position of the rear support piece. The foot strap is not, however, adjustable, so that during an adjustment the position of the boot on the snowboard varies, which is undesirable in principle, the behavior of the snowboard being affected thereby.

The fixing of the rear support piece and of the foot strap on the base plate by means of screws requires at least four screws and often six screws, as is the case of the binding according to U.S. Pat. No. 5,727,797. For snowboard rental outlets, which very often have to adjust the bindings, this therefore requires the screwing in and unscrewing of at least four nuts or screws, with the risk of losing nuts and screws, without taking into account the time spent on such an operation in order to obtain symmetrical adjustment which does not modify the position of the boot relative to the snowboard.

In order to offset this drawback, a snowboard binding with symmetrical adjustment based on an axial screw having two opposed screw threads, ensuring the displacement of nuts linked respectively to a rear support piece and to one or two front support pieces, was proposed in document U.S. Pat. No. 6,267,403, the content of which is incorporated by reference. This construction occupies a relatively significant height above the base plate, given that the screw and the nuts, located above the base plate, have themselves to be covered over with a covering plate.

The binding described in document FR 2 732 611, the content of which is incorporated by reference, also describes a snowboard binding in which the length can be adjusted by means of an axial screw, the position of the rear binding element, however, being fixed, such that adjustment is not symmetrical.

SUMMARY OF THE INVENTION

The object of the present invention is to achieve a snowboard binding with rapid adjustment, leaving the central zone of the base plate free and not using screws of the endless-screw type.

The snowboard binding according to the invention is defined in that the kinematic linking means between the foot strap and the rear support piece consist of linking pieces connecting the rear support piece and the foot strap and passing on either side of the central zone of the base plate, i.e. leaving this central zone, which generally has a circular cutout for orientation of the base plate on the snowboard, free.

According to a first embodiment, the linking pieces consist of arms connected respectively to the ends of the foot strap and directly or indirectly to the sides of the rear support piece, these arms being superposed in pairs, means being provided for immobilizing the arms in a selected superposed position, and the base plate having means for guiding the arms.

In an embodiment in which the arch is fixed, the base plate has two vertical walls on its lateral sides, these walls having an aperture at the front and an aperture at the rear, these apertures which are parallel to the plane of the base plate being traversed by rivets for attaching the foot strap to the base plate and rivets for attaching the rear support piece to the base plate. The linking pieces consist of two notched small plates which are parallel to the vertical walls of the base plate and attached respectively to each of the ends of the foot strap and of two similar notched small plates attached respectively to each side of the rear support piece and being superposed via their notched surfaces to the small plates connected to the foot strap, the small plates having a longitudinal aperture in their zone of superposition such that these apertures are superposed, a fixing means traversing these apertures in order to immobilize the small plates on the vertical walls of the base plate.

In an embodiment in which the rear support piece is mounted on the arch and displaceable with the arch, the base plate has two vertical walls on its lateral sides, these walls having an aperture at the front and an aperture at the rear, these apertures which are parallel to the plane of the base plate being traversed by rivets for attaching the foot strap to the base plate and rivets for attaching the rear support piece to the base plate. The linking pieces consist of two notched small plates attached respectively to each of the ends of the foot strap and of two notched small plates attached respectively to each side of the arch and superposed via their notched surfaces on the small plates connected to the foot strap, the small plates having a longitudinal aperture in their zone of superposition such that these apertures are superposed, a fixing means traversing these apertures in order to immobilize the small plates on the vertical walls of the base plate.

In both cases, the vertical walls of the base plate advantageously have a threaded hole between the apertures, and the fixing means is a screw with a knurled or notched head which applies the small plates against the vertical walls of the base plate.

According to another embodiment, in which the arch is fixed on the base plate, the linking pieces consist of two flexible strips, for example strips made from steel, connecting respectively one of the ends of the foot strap to the opposite side of the rear support piece, passing via the rear of the base plate.

According to one embodiment, the base plate has means for guiding the flexible strips, and the binding comprises means for symmetrical entrainment of the flexible strips and means for immobilizing these strips.

To this end, the entrainment means advantageously consist of a pinion interacting with two opposite toothings formed on the flexible strips in their zone of superposition.

According to one embodiment, the immobilization means consist of projections on one face of the pinion and of a screw head.

In this case, also, the base plate may have two vertical walls on its lateral sides, these walls having an aperture at the front and an aperture at the rear. The flexible strips also have an aperture interacting respectively with each of the rear apertures in the walls of the base plate, these apertures being traversed by rivets for attaching the foot strap and for attaching the rear support piece to the flexible strips.

Linking by means of flexible strips is also applicable to an embodiment in which the rear support piece is mounted on the arch and can be displaced with the arch on the base plate.

"Rivet" is understood to mean all equivalent fixing means.

The appended drawing represents, by way of example, three embodiments of the invention.

BRIEF DESCRIPTION OF THE DRAWINGS

FIG. 2 is a perspective view of the binding according to the first embodiment in a first position.

FIG. 3 is a side view of the binding in the first position.

DESCRIPTION OF THE PREFERRED EMBODIMENTS

Figure 1:
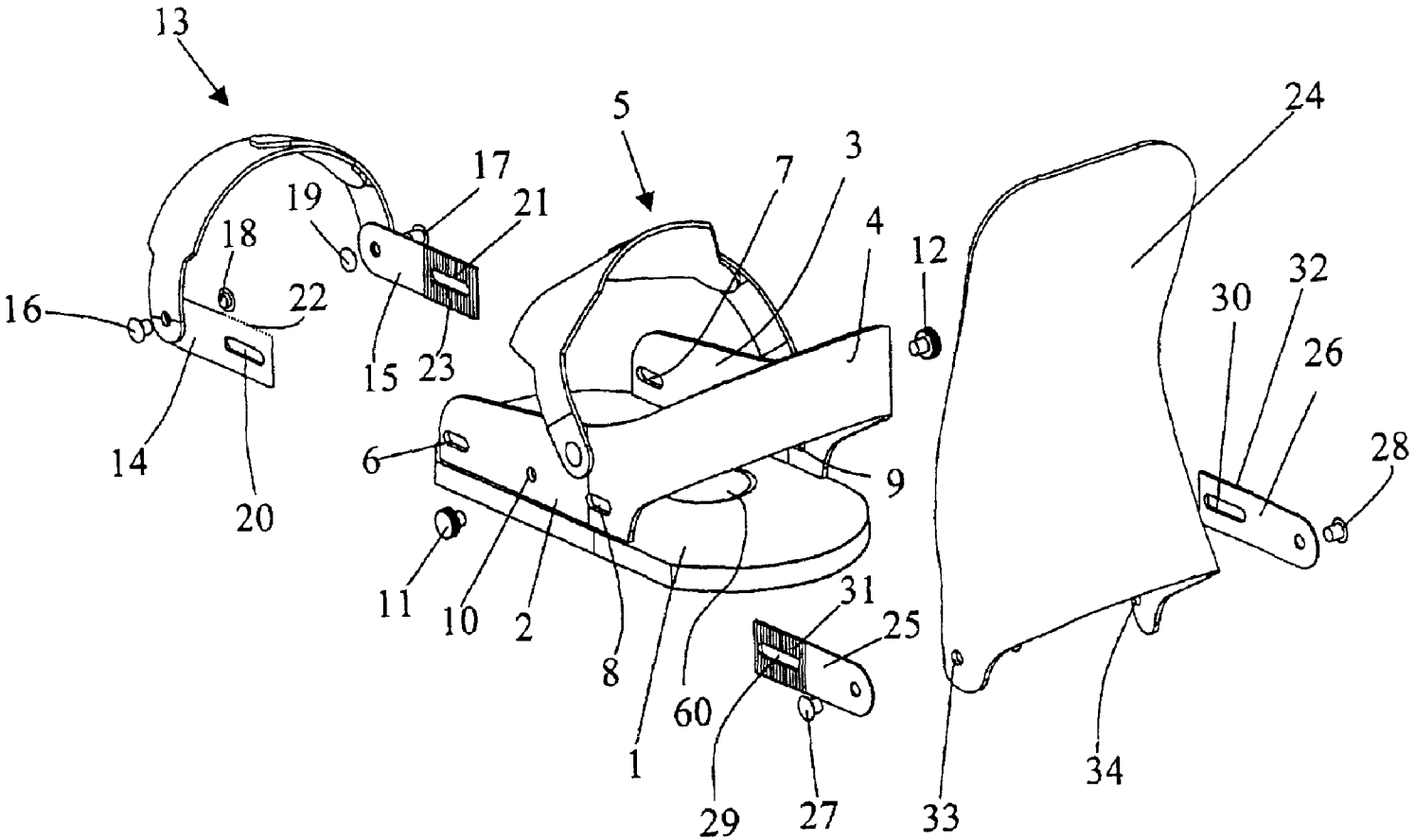
FIG. 1 is an exploded view of a first embodiment.

The binding shown in FIGS. 1 to 5 comprises a base plate 1 in the form of a plate with parallel, rectilinear lateral sides, this base plate being intended for fixing directly or indirectly onto a snowboard. In its central zone, the base plate 1 has, in a known manner, a circular cutout 60 allowing it be oriented on the snowboard. Along each of these lateral sides, the base plate has a vertical wall 2 or 3, these walls extending rearward via an arch 4 extending obliquely rearward. In the zone where these walls join up with the arch 4, a first strap 5 for passing over the boot in the zone of the instep is mounted on the walls 2 and 3. The strap 5 is shown diagrammatically by means of two strands which are superposed. The coupling means, and, if appropriate, tensioning means have not been shown. All known types of buckle may be used for this purpose. The walls 2 and 3 have, at the front, a first aperture 6 or 7, the direction of which extends parallel to the plane of the base plate 1. At the rear, the walls 2 and 3 have a second aperture 8 or 9, also extending parallel to the plane of the base plate 1 and aligned on the apertures 6 or 7. Between the apertures 6 and 8 or 7 and 9, the walls 2 and 3 have a threaded hole 10. The corresponding hole in the wall 3, is concealed by the arch 4. These holes are aligned with the corresponding apertures 6, 8 or 7, 9. They are intended for receiving a screw with a knurled head 11 or 12.

The binding also includes a second strap 13 intended for passing over the front part of the boot, surrounding the foot. This strap 13 will be called the "foot strap". Like the strap 5, it is shown diagrammatically by means of two strands, without coupling means and, if appropriate, without tensioning means. This foot strap 13 is mounted at the end of two rectangular small plates 14 and 15 by means of rivets 16 and 17 and counter rivets 18 and 19. The small plates 14 and 15 have a longitudinal aperture 20 or 21. The inner faces, which face one another, of the small plates 14 and 15 are notched vertically in the zone of the apertures 20 and 21. The notches 22 and 23 are visible in FIG. 1.

At the rear, inside the arch 4, the binding comprises a rear support plate 24, the largest part of which is in the form of a trough rising above the base plate 1 and itself bearing in a known manner against the arch 4. This support plate 24, intended for supporting the leg, is articulated on two rectangular small plates 25 and 26, which are identical to the small plates 14 and 15, by means of rivets 27 and 28. The small plates 25 and 26 thus also have a longitudinal aperture 29 or 30, and a notched surface 31 or 32, this surface, however, in this case facing toward the outside of the binding.

In the assembled state, as shown, for example, in FIG. 2, the small plates 14, 15, 25, 26 are located outside the vertical walls 2 and 3 of the base plate. The rivets 16 and 17 traverse the apertures 6 and 7, the counter rivets 18 and 19 thus being inside the walls 2 and 3. Similarly, the rivets 27 and 28 traverse the apertures 8 and 9 and the holes 33 and 34 in the support plate 24, their counter rivets being inside the support plate. The small plates are superposed in pairs via their notched surfaces, as may be seen in FIG. 2 in the case of the small plates 14 and 25. The small plates are immobilized on the walls 2 and 3 by means of the screws 11 and 12. The superposition of the apertures in the small plates makes it possible to obtain several relative positions of the superposed plates.

FIGS. 2 and 3 illustrate a first adjustment of the binding, in which the foot strap 13 is relatively forward and the support plate 24 relatively rearward, which corresponds to a large boot size.

Figure 4:
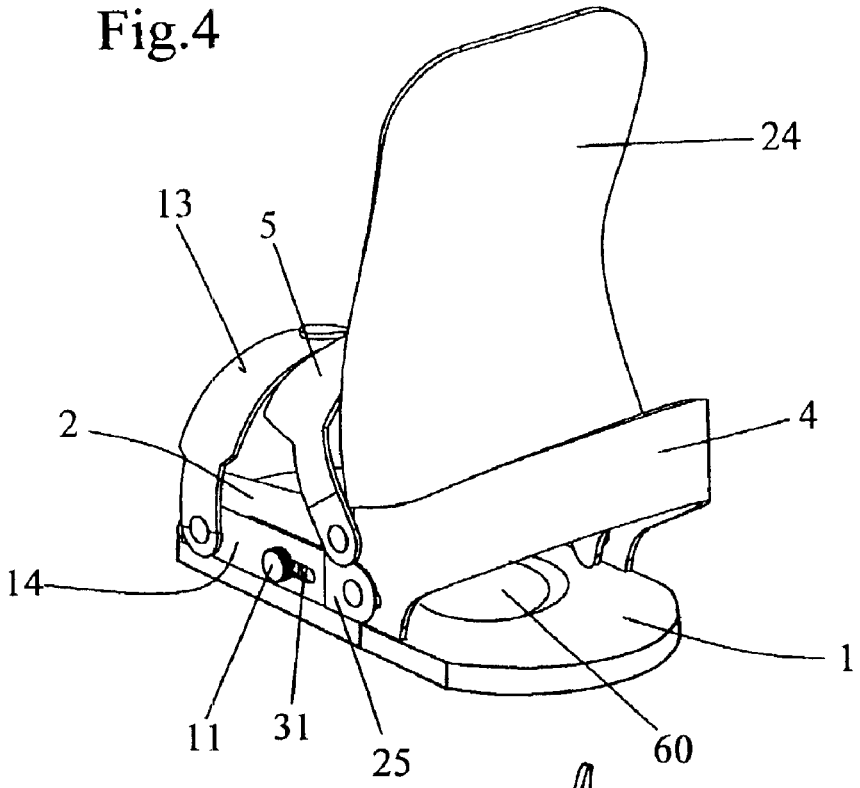
FIG. 4 is a perspective view of the binding according to the first embodiment in a second position.
Figure 5:
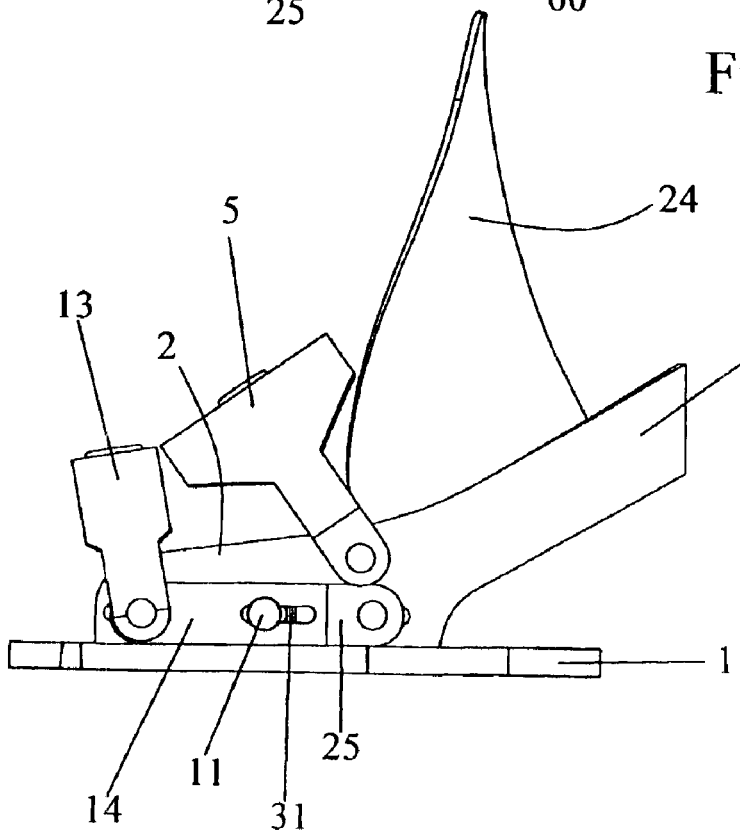
FIG. 5 is a side view of the binding shown in FIG. 4.

FIGS. 4 and 5 illustrate a second adjustment, in which the foot strap 13 and the support plate 24 are closer to one another and closer to the center of the base plate 1, which corresponds to a small boot size.

In order to modify the adjustment, it suffices to partially loosen the screws 11 and 12 so that the notched surfaces can be disengaged from one another, which makes it possible to displace the foot strap 13 and the support plate 24 in the apertures 6 to 9, and then to retighten the screws 11 and 12 in the desired position. It will be observed that it is possible to displace the strap 13 and the support plate 24 either symmetrically relative to a point on the base plate, or asymmetrically. It is thus possible to displace a boot relative to the binding in order to modify the position of the foot on the snowboard.

In variant embodiments, the linking small plates could be located on the inner side of the walls 2 and 3 or in these walls or, alternatively, on the base plate, parallel to the base plate, on either side of the central circular cutout 60.

Figure 6:
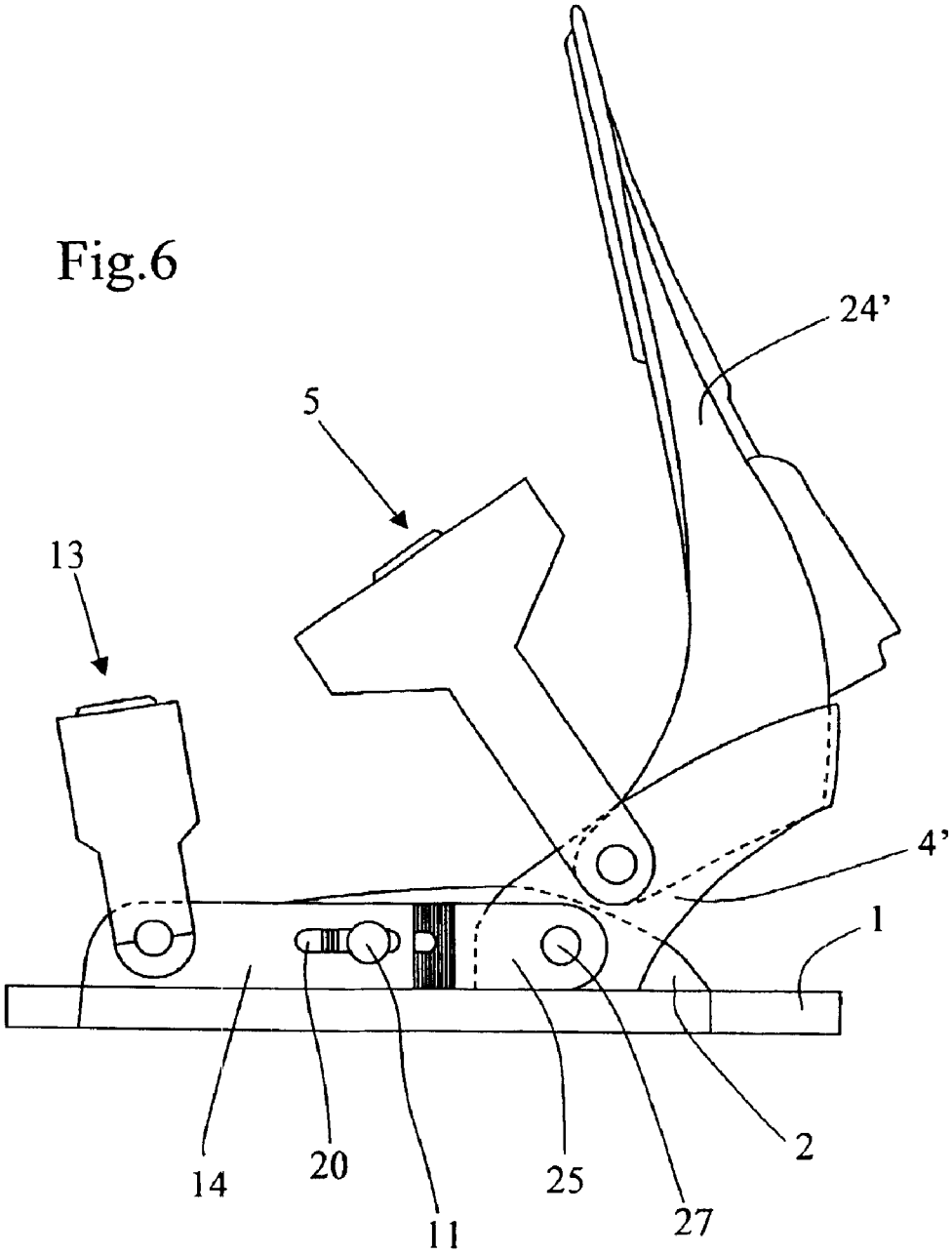
FIG. 6 shows a second embodiment in which the rear support piece is mounted on a movable arch, the rest of the construction being identical to the first embodiment.

In the variant embodiment shown in FIG. 6, the arch 4' is independent of the vertical walls 2 and 3, and it is the arch which is secured to the small plates 25 and 26, the support plate 24' being mounted on the arch 4'. The arch 4' is also guided by means of its bearing on the base plate 1.

Figure 7:
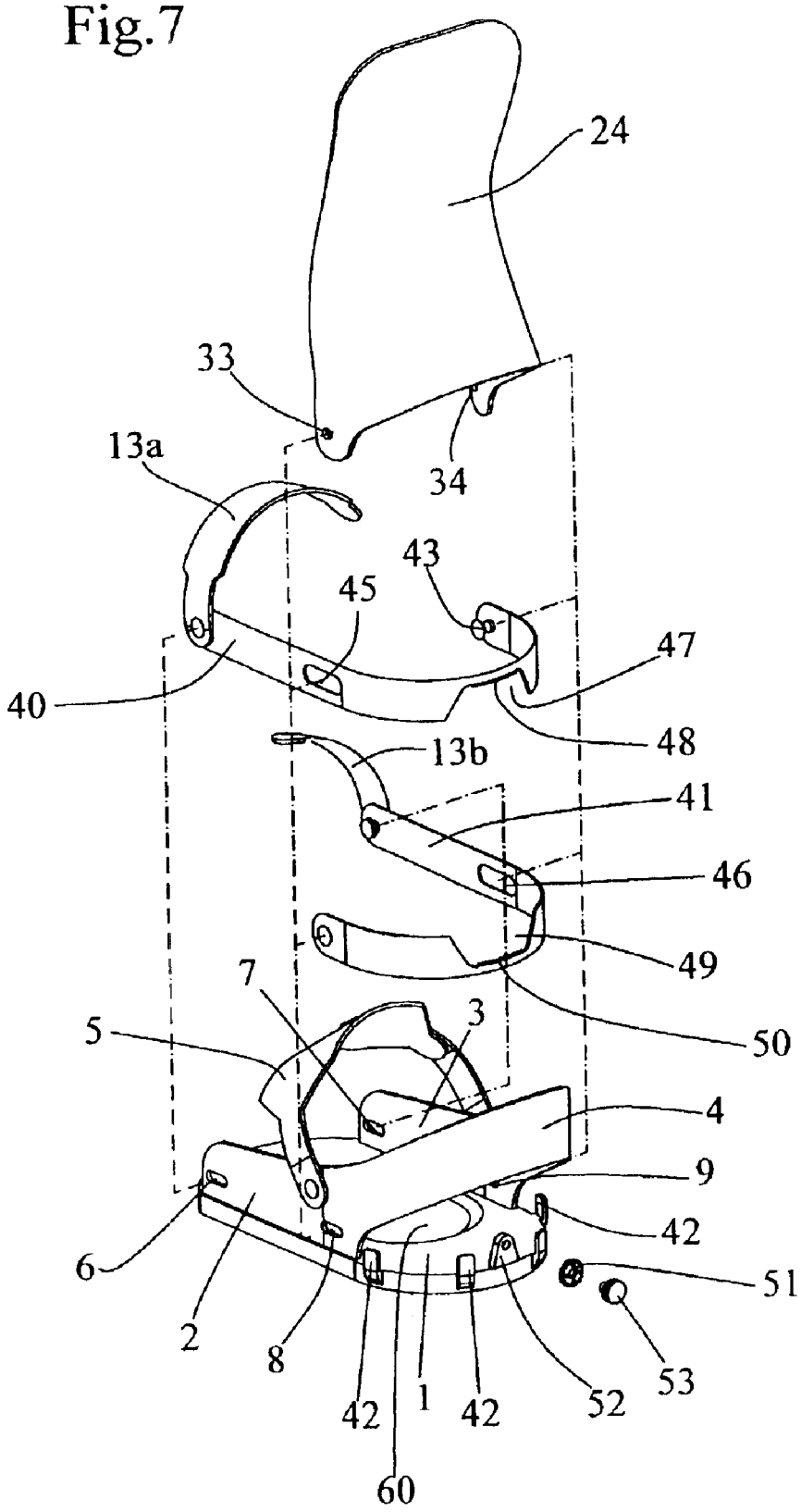
FIG. 7 is an exploded view of a third embodiment.
Figure 8:
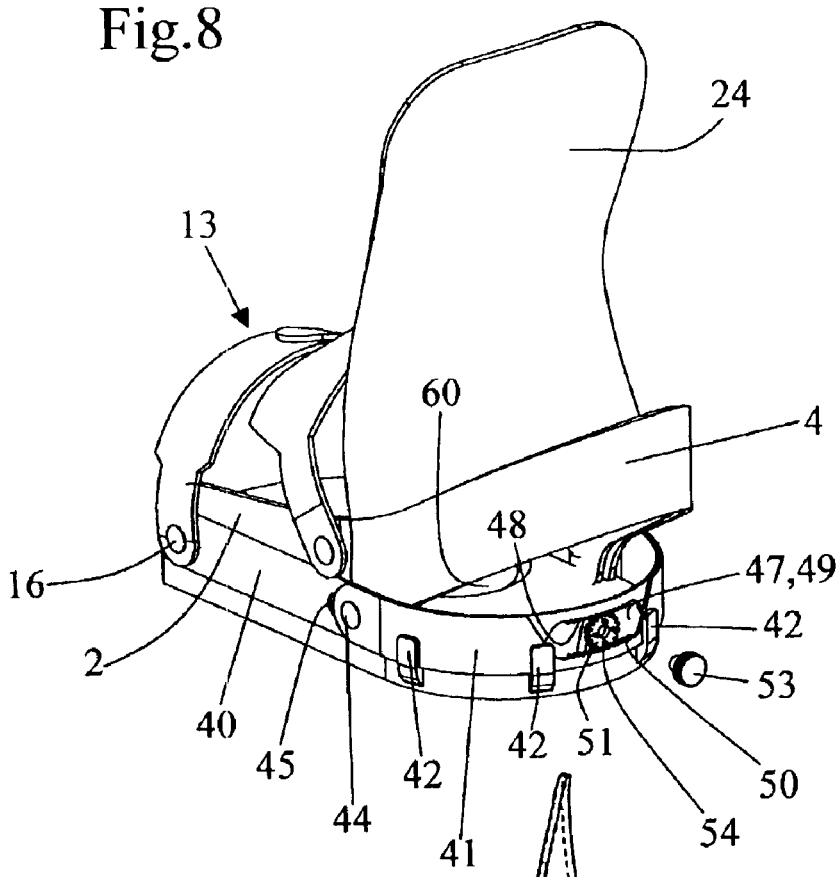
FIG. 8 is a perspective view of the rear of the binding according to the third embodiment.
Figure 9:
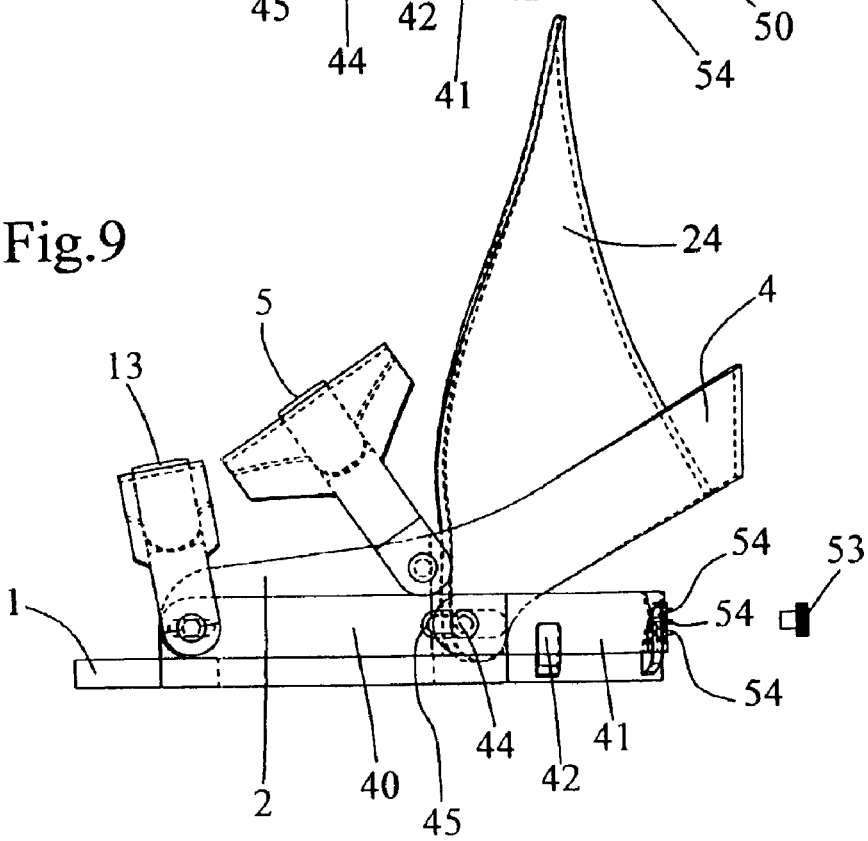
FIG. 9 is a side view of the binding shown in FIG. 8.

A third embodiment, shown in FIGS. 7 to 9, has several points in common with the first embodiment and, in order to avoid repetitions, the common points have been denoted by the same references as in FIG. 1.

One 13*a* of the strands of the foot strap 13 is attached to the end of a first flexible strip 40, preferably made from steel, while the other strip 13*b* is attached to one end of a second flexible strip 41, similar to the strip 40. These flexible strips 40 and 41 are superposed at the rear of the base plate 1, where they are guided by four tabs 42 so that they adopt a curvature in the form of an arc of a circle. The other end of the flexible strip 40 is connected to one of the sides of the support plate 24 by means of a rivet 43 traversing the hole 34 in the support plate. Similarly, the other end of the flexible strip 41 is attached to the other side of the support plate 24 by means of a rivet 44 (FIG. 8).

The flexible strip 40 has a longitudinal aperture 45 interacting with the aperture 8 in the base plate for the passage of the rivet 44 through the wall 2 of the base plate. Similarly, the flexible strip 41 has an aperture 46 interacting with the aperture 9 in the base plate for the passage of the opposite rivet.

In its curved part, the flexible strip 40 has a notch 47 of trapezoidal shape, the bottom of which has a toothing 48 of the rack type. The flexible strip 41 is equipped with a similar notch 49, the bottom of which has a toothing 50, the notches 47 and 49 opening on the opposite sides of the flexible strips, the depth of the notches being such that it frees a space occupied by a pinion 51. This pinion 51 is mounted rotatably on a base 52 located on the opposite side from the guide tabs 42 relative to the flexible blades. The pinion 51 is pivoted on the base 52 by means of screw 53 with a knurled head which is screwed into the base 52. The pinion 51 meshes simultaneously with the two toothings 48 and 50. The outer face of the pinion 51 has four regularly distributed studs 54, and the face of the screw head 53 opposite these studs has a series of hollows located on a circle corresponding to the circle passing through the studs 54, such that the studs 54 can engage in the hollows of the screw 53.

In the use position, the pinion 51 is immobilized in terms of rotation by the screw 53. In order to carry out an adjustment, it suffices partially to loosen the screw 53 in order to release the studs 54, which makes it possible to entrain the flexible strips 40 and 41 via the strap 13 and the support plate 24. The presence of the pinion 51 and of the toothings 48 and 50 ensures symmetrical displacement of the strap 13 and of the support plate 24. It then suffices to retighten the screw 53 in order to immobilize the flexible strips.

Instead of the screw 53, it would be possible to use a piece which does not rotate but which can be displaced axially. The engagement of the studs 54 in this non-rotating piece immobilizes the pinion in terms of rotation.

The immobilizing means could also be of the cam and lever type, as in document WO 00/339,222.

As already mentioned, the instep strap 5 could be dispensed with, and the strap 13 enlarged so as to reach as far as the instep.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A snowboard binding comprising a base plate having two at least approximately parallel lateral sides, an arch extending obliquely rearward, a rear support piece rising inside the arch and displaceable on the base plate in parallel with the lateral sides of the base plate, and a foot strap for passing over a boot and displaceable on the base plate in parallel with the lateral sides of the base plate, and a kinematic linking mechanism between the foot strap and the rear support piece, wherein the kinematic linking mechanism comprises linking pieces equipped with length adjusting means, the linking pieces connecting the support piece and the foot strap and passing on either side of the central zone of the base plate.

2. The binding as claimed in claim 1, wherein the linking pieces comprise arms connected respectively to the ends of the foot strap and, directly or indirectly, to the sides of the rear support piece, these arms being superposed in pairs, an immobilizing device for the arms for immobilizing the arms in a selected superposed position, and wherein the base plate has a guide for said arms.

3. The binding as claimed in claim 1, in which the arch is fixed, wherein the base plate has two vertical walls on its lateral sides, these walls having an aperture at the front and an aperture at the rear, these apertures being parallel to the plane of the base plate and traversed by rivets for attaching the foot strap to the base plate and rivets for attaching the rear support piece to the base plate, and wherein the linking pieces comprise two small plates having notched surfaces attached respectively to each of the ends of the foot strap and two small plates having corresponding notched surfaces attached respectively to each side of the rear support piece, the notched surfaces of the plates attached to the rear support piece being superposed in a zone of superposition on the notched surfaces of the small plates connected to the foot strap, the plates each having a longitudinal aperture in their zone of superposition such that when these apertures are superposed, a fixing means may traverse these apertures in order to immobilize the small plates on the vertical walls of the base plate.

4. The binding as claimed in claim 1, in which the rear support piece is mounted on the arch and displaceable with the arch, wherein the base plate has two vertical walls on its lateral sides, these walls having an aperture at the front and an aperture at the rear, these apertures being parallel to the plane of the base plate and traversed by rivets for attaching the foot strap to the base plate and rivets for attaching the arch to the base plate, and wherein the linking pieces comprise two small plates having notched surfaces attached respectively to each of the ends of the foot strap and two small plates having corresponding notched surfaces attached respectively to each of the arch, the notched surfaces of the plates attached to the rear support piece being superposed in a zone of superposition on the notched surfaces of the small plates connected to the foot strap, the plates each having a longitudinal aperture in their zone of superposition such that when these apertures are superposed, a fixing means may traverse these apertures in order to immobilize the small plates on the vertical walls of the base plate.

5. The binding as claimed in claim 3 or 4, wherein the vertical walls have threaded holes between the apertures, and wherein the fixing device is a screw with a knurled or notched head screwed into the threaded holes.

6. The binding as claimed in claim 1, in which the arch is fixed on the base plate, wherein the linking pieces comprise two flexible strips and means for ensuring the symmetrical displacement of the flexible strips and means for immobilizing the flexible strips.

7. The binding as claimed in claim 1, in which the rear support piece is mounted on the arch and displaceable with the arch, wherein the linking pieces comprise two flexible strips, means for ensuring the symmetrical displacement of the flexible strips, and means for immobilizing the flexible strips.

8. The binding as claimed in either of claim 6 or 7, wherein the symmetrical displacement means comprise a pinion interacting with two opposite toothings formed on the flexible strips in their zone of superposition.

9. The binding as claimed in claim 8, wherein the means for immobilizing the flexible strips comprise projections on one face of the pinion and of a screw head.

10. The binding as claimed in one of claim 6, 7 or 9, wherein the base plate has two vertical walls on its lateral sides, these walls having an aperture at the front and an aperture at the rear, these apertures being parallel to the plane of the base plate, and wherein the flexible strips also have an aperture interacting respectively with each of the rear apertures in the walls of the base plate, these apertures being traversed by rivets for attaching the foot strap and for attaching the rear support piece to the flexible strips.

11. A snowboard binding comprising a base plate having two at least approximately parallel lateral sides, an arch extending obliquely rearward, a rear support piece rising inside the arch and displaceable on the base plate in parallel with the lateral sides of the base plate, and a foot strap for passing over a boot and displaceable on the base plate in parallel with the lateral sides of the base plate, and a kinematic linking mechanism between the foot strap and the rear support piece, wherein the kinematic linking mechanism comprises linking pieces equipped with length adjusting means, the linking pieces connecting the support piece and the foot strap and passing on either side of the central zone of the base plate, wherein further, the linking pieces translate in guiding means.

* * * * *